United States Patent [19]

Camprubi

[11] 4,160,468

[45] Jul. 10, 1979

[54] WEFT SELECTOR MECHANISM

[75] Inventor: Anselmo B. Camprubi, Barcelona, Spain

[73] Assignee: Incotex S.A., Sabadell, Spain

[21] Appl. No.: 887,842

[22] Filed: Mar. 17, 1978

Related U.S. Application Data

[63] Continuation-in-part of Ser. No. 746,204, Dec. 1, 1976, abandoned, which is a continuation of Ser. No. 621,367, Oct. 8, 1975, abandoned.

[30] Foreign Application Priority Data

Oct. 11, 1974 [ES] Spain ..... 206.559

[51] Int. Cl.[2] ..... D03D 47/38

[52] U.S. Cl. ..... 139/453

[58] Field of Search ..... 139/453; 66/125, 132

[56] References Cited

U.S. PATENT DOCUMENTS

| | | | |
|---|---|---|---|
| 3,364,954 | 1/1968 | Kokkinis | 139/453 |
| 3,439,715 | 4/1969 | Juillard | 139/453 |
| 3,941,158 | 3/1976 | Joans | 139/453 |

FOREIGN PATENT DOCUMENTS

| | | | |
|---|---|---|---|
| 1262490 | 2/1972 | United Kingdom | 139/453 |
| 2509664 | 9/1976 | United Kingdom | 139/453 |

*Primary Examiner*—Henry Jaudon

*Attorney, Agent, or Firm*—Toren, McGeady and Stanger

[57] ABSTRACT

A compact simplified weft selector mechanism is formed in an assembly where a plurality of weft selector arms are pivoted about a fixed shaft with the operating ends of the arms engaging a weft thread whereby selection of a particular arm operates to select a particular weft thread for engagement by a loom needle. A plurality of arms or levers are individually mounted by swivel bearings to be guided by oblique slots for movement of the operating ends of the levers through a common point.

4 Claims, 4 Drawing Figures

WEFT SELECTOR MECHANISM

This application is a continuation-in-part application of prior application Ser. No. 746,204 filed, Dec. 1, 1976 which is, in turn, a continuation of prior application Ser. No. 621,367 filed Oct. 8, 1975, both now abandoned.

BACKGROUND OF THE INVENTION

The present invention relates generally to textile equipment and more particularly to the overall structure and organization of a weft selection mechanism.

The invention is directed toward a particular structure and organization of such a weft selector mechanism wherein a plurality of levers may have ends thereof engaging weft threads with selective rotation of the levers about a common shaft operating to effect selection of a desired weft thread.

Loom equipment for textiles generally are of a type where individual components of a loom are usually required in great numbers because of high output requirements which may exist in a textile facility. Accordingly, structural simplification of loom components can give rise to significant cost savings when multiplied by the number of looms within which a particular item or component is to be used. In addition to structural simplification and cost reduction in the manufacture thereof, mechanisms for looms will provide significant advantages if they can operate effectively and reliably to perform a particular loom function despite simplicity of design and structure.

The present invention relates basically to such a simplified weft selector mechanism for looms which enables several improvements of a practical nature and structural scope to be effected in the art of weft selector devices.

SUMMARY OF THE INVENTION

Briefly, the present invention may be described as a weft selector mechanism for looms comprising a casing, a plurality of weft selector levers each having a first and a second end, shaft means within said casing, swivel bearing means swivelly rotatably mounting said plurality of weft selector levers on said shaft means intermediate said first and second ends of said levers, means defining on opposite sides of said casing lateral slots extending obliquely to said shaft means, said lateral slots being arranged to have said first and said second ends of said weft selector levers, respectively, positioned for sliding engagement therein for guiding movement of said levers, means for engaging weft threads at said first end of each of said weft selector levers, drive means engaging said second ends of said weft selector levers for rotating said levers about said swivel bearing means, and spring means for biasing said weft selector levers to a return position. The weft selector levers are mounted upon the shaft means by the swivel bearing means in such a manner that the first ends of a plurality of the weft selector levers may all be passed through a common point by rotation about the shaft means as a result of guiding engagement of the ends of the weft selector levers within the slots formed in the casing. Because of the swivel action of the bearings, which may be formed from flexible bushings, the guide slots may be arranged to lie within a plane extending obliquely to the shaft means thereby to effect movement of the first ends of the plurality of weft selector levers through a common point.

As a result of the construction of the present invention, the weft selector levers may be arranged in two groups with the first ends of each of the levers of a group passing through a common point as a result of the converging orientations of the guide slots. The guide slots may be arranged so that a first group of levers has first ends all passing through a common point upon pivoting of the levers about the shaft means with a second group of levers passing through a second common point.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
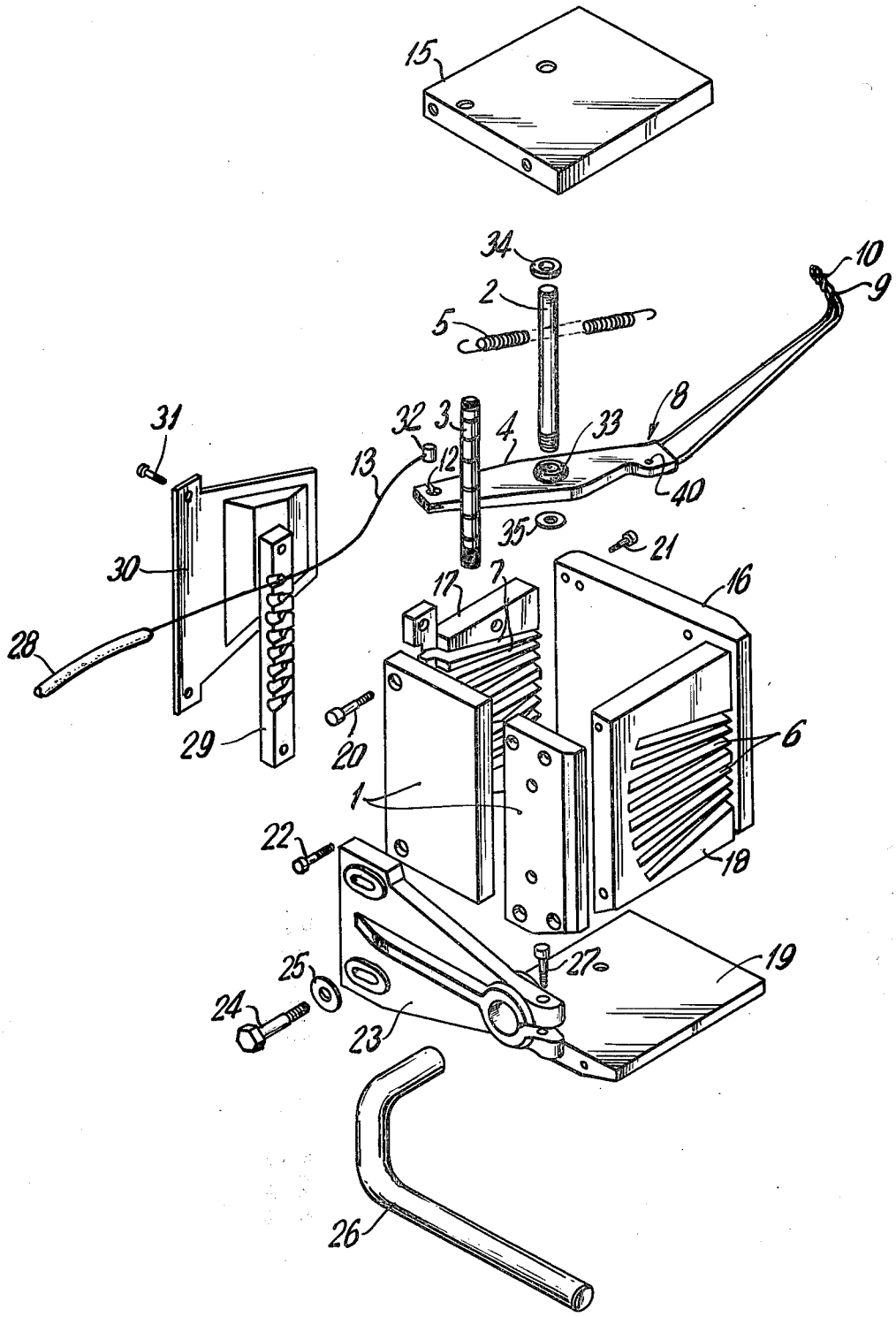
FIG. 1 is an exploded view of the weft selector mechanism according to the present invention.

As will be seen from the drawings, the weft selector mechanism of the present invention is basically composed of a casing which includes rear covers 1, a front cover 16, a pair of sides 17 and 18, a lower cover 19 and a top cover 15. The casing thus described may be assembled and held together, in a manner obvious to those skilled in the art, by utilization of attachment means such as screws 20, 21 and 22.

The opposed sides 17 and 18 of the casing each have formed therein oblique slots 7, 6, respectively.

A pivot pin or shaft 2 is mounted within the casing with one end thereof attached to the top cover 15 through a washer 34 with the other end thereof being attached to the lower cover 19 through a washer 35.

Mounted upon the shaft 2 for pivotal movement thereabout are a plurality of levers 8 which are connected to the shaft 2 at a point intermediate their ends by swivel bearings or flexible bushings 33. Each of the levers 8 has a first end at which there is located an eyelet 10 formed at the end of a hook end 9 with the eyelet 10 being adapted to engage a weft thread 11 to effect selection of the weft thread and engagement thereof by a needle 14.

Figure 2:
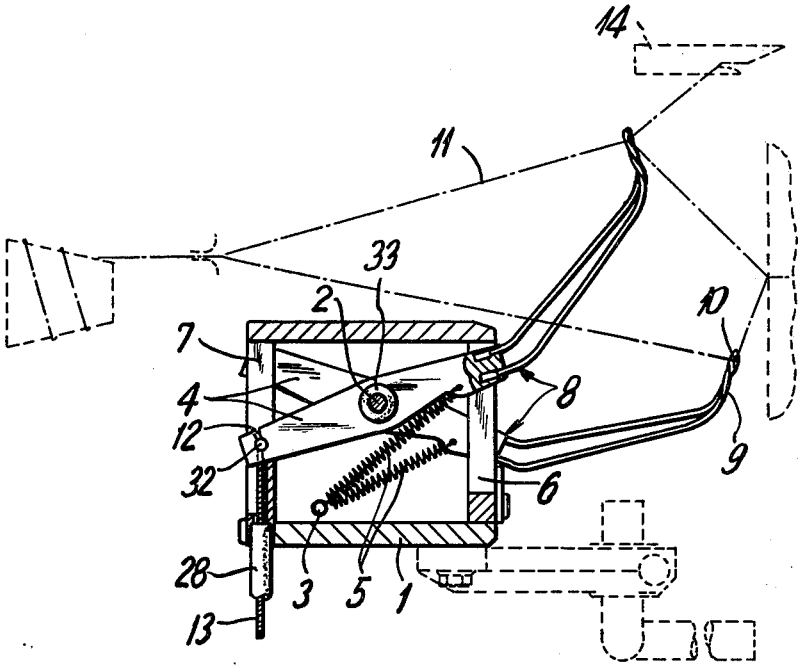
FIG. 2 is schematic cross sectional view of the weft selector mechanism of the invention in assembled form.

Each lever 8 has a second end or rear section 4 which includes a coupling slot 12. The coupling slot 12 is adapted to be engaged by a toggle 32 located at the end of a cable 13 which is engaged within a sheath 28. A guide strip 29 operates to permit a plurality of cables 13 to extend to within the casing for engagement of the coupling slots 12 of each lever 8 mounted within the casing. A side cover 30 is mounted over the guide strip 29 and the side 17 by means of screws 31. Actuation of the cable 13 in a downward direction, as seen in FIG. 2, will effect downward movement of the second or left end of the lever 8 thereby causing the lever to pivot in a counterclockwise direction about the shaft 2 as viewed in FIG. 2.

Included within the casing is a pin 3 which has one end of each of a plurality of return springs 5 attached thereto. The other end of the return springs 5 is attached to a respective lever 8 through an orifice 40 and the pin 3 is connected across the interior of the casing between the top cover 15 and the lower cover 19. Thus, when the cable 13 causes a lever 8 to be rotated about the shaft 2 in a clockwise direction, as previously described, the return spring 5 will cause the lever 8 to rotate clockwise, as seen in FIG. 2, to return the lever 8 to its original position after the force applied through the cable 13 has been released.

The entire mechanism described may be mounted at an appropriate position upon a loom by a tie bar 26 which connects to a support member 23 attached to the casing by means of screws 24 and 27 and washer 25.

As will be apparent, a plurality of levers 8 are provided within the casing of the invention. Each of the levers 8 has connected at its second end a cable 13 with the first end of each lever engaging through the eyelet 10 with a weft thread 11. Thus, selective actuation of a cable 13 will cause a particular lever to rotate in the manner previously described to effect selection of a weft thread 11.

Each of the levers 8 is mounted within the casing so that its first end extends through one of the slots 6 while its second end or rear section 4 is engaged within one of the slots 7. As best seen in FIG. 1, each of the slots 6 and 7 is arranged to extend obliquely relative to the shaft 2. That is, the slots 6 and 7 are arranged to include slots which lie in a plane which will extend at an oblique angle relative to the central axis of the shaft 2.

Figure 3:
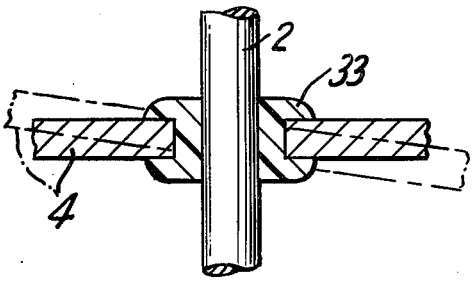
FIG. 3 is a sectional view showing in detail a particular portion of the mechanism of the invention and FIG. 4 is a side assembly depicting the arrangement of the two groups of levers of the invention.

Inasmuch as the levers 8 are engaged at both ends within a slot 6, 7 respectively, when the levers are caused to rotate about the shaft 2, movement of the lever ends will be guided by the directional orientation of the slots 6, 7. Since the slots extend obliquely to the shaft 2, the ends of the levers will be guided with directional components which will extend both radially and axially of the shaft 2. This is enabled by utilization of the swivel bearing 33. The swivel bearing 33 operates, as seen in FIG. 3, to permit movement of the levers 8 in the manner indicated, as depicted by the dotted line position of a lever 8 shown in FIG. 3.

Thus, by proper orientation of the slots 6 and 7, a plurality of levers 8 may be arranged so that when they are pivoted about the shaft 2 each end or eyelet 10 of a group of such levers 8 may be caused to pass through a common point.

Figure 4:
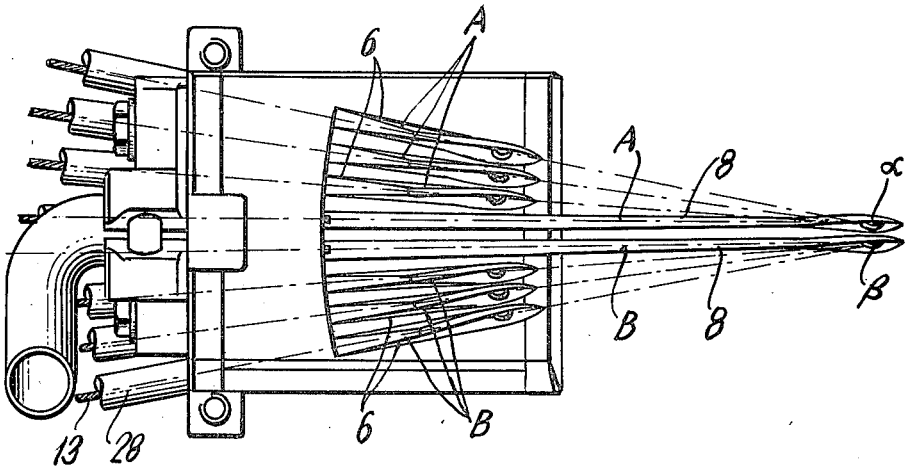

In the arrangement of the present invention as best seen in FIG. 4, there are provided two sets A and B of levers 8. Each set A and B is composed of four levers each of which has its eyelet 10 passing through a common point $\alpha$ or $\beta$. The second set B of four levers is arranged so that eyelet 10 of the second set B passes through a common point $\beta$, this point being different from the common point $\alpha$ of the first set A of levers. As will be apparent from FIG. 1, a total of eight slots 6 and eight slots 7 are provided with the slots being appropriately oriented to effect the desired movement of the levers 8. The swivel bearing means 33 which are provided may be in the form of flexible bushings or the like and should operate to enable sufficient latitude in the movement of the levers 8 in order to allow provision for the indicated motion.

Of course, as will be apparent to those skilled in the art, more or less levers 8 may be provided and the arrangement of the invention may be such that only one set of levers is provided each of which has a first end or eyelet 10 passing through a common point.

While a specific embodiment of the invention has been shown and described in detail to illustrate the application of the inventive principles, it will be understood that the invention may be embodied otherwise without departing from such principles.

What is claimed is:

1. A weft selector mechanism for looms comprising a casing, a plurality of weft selector levers each having a first and a second end, shaft means within said casing, swivel bearing means comprising flexible bushings mounting each of said weft selector levers on said shaft means at points intermediate said ends of each lever for swiveling pivotal motion about said shaft means, means defining slots in said casing, said slots extending in a direction obliquely to said shaft means and having said weft selector levers guidingly engaged therein to effect movement of said first ends of said weft selector levers through a common point when said levers are pivoted about said shaft means, and drive means engaging said levers at said second ends to selectively effect pivoting thereof about said shaft means.

2. A weft selector mechanism for looms comprising a casing, a plurality of weft selector levers each having a first and a second end, shaft means within said casing, swivel bearing means mounting each of said weft selector levers on said shaft means at points intermediate said ends of each lever for swiveling pivotal motion about said shaft means, means defining slots in said casing, said slots extending in a direction obliquely to said shaft means and having said weft selector levers guidingly engaged therein to effect movement of said first ends of said weft selector levers through a common point when said levers are pivoted about said shaft means, and drive means engaging said levers at said second ends to selectively effect pivoting thereof about said shaft means, said slots guidingly engaging said weft selector levers both at said first ends and at said second ends.

3. A mechanism according to claim 1 or 2 wherein there are provided two groups of said weft selector levers and two groups of respective slots in said casing to guide movement of said groups of weft selector levers, respectively, said slots being arranged such that the first ends of each group of levers pass through a common point, the common point for said first group being different than the common point for said second group.

4. A mechanism according to claim 1 or 2 further including a plurality of cables, there being provided one cable each for each of said weft selector levers, said cables engaging each weft selector lever at said second end to enable selective pivoting of each lever about said shaft means and spring means engaged between said weft selector levers and said casing to bias said weft selector levers for return motion after pivoting thereof by said cables.

* * * * *